US008025105B2

(12) United States Patent
Templeton et al.

(10) Patent No.: US 8,025,105 B2
(45) Date of Patent: Sep. 27, 2011

(54) DOWNHOLE TOOL RETRIEVAL AND SETTING SYSTEM

(75) Inventors: Garry Wayne Templeton, The Woodlands, TX (US); Andre N. Broussard, The Woodlands, TX (US); Monte Ira Johnson, The Woodlands, TX (US); Mark William Schnitker, Friendswood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 8 days.

(21) Appl. No.: 11/833,680

(22) Filed: Aug. 3, 2007

(65) Prior Publication Data

US 2008/0029276 A1 Feb. 7, 2008

Related U.S. Application Data

(60) Provisional application No. 60/821,624, filed on Aug. 7, 2006.

(51) Int. Cl.
*E21B 23/00* (2006.01)

(52) U.S. Cl. ..... 166/377; 166/117.5

(58) Field of Classification Search ..... 166/117.5, 166/117.6, 377, 381; 405/133
See application file for complete search history.

(56) References Cited

U.S. PATENT DOCUMENTS

| | | | | |
|---|---|---|---|---|
| 1,951,638 A | | 3/1934 | Walker | |
| 2,132,061 A | * | 10/1938 | Walker | 166/117.6 |
| 2,409,811 A | | 10/1946 | Taylor, Jr. et al. | |
| 2,506,799 A | * | 5/1950 | Livingston | 166/117.6 |
| 3,516,703 A | | 6/1970 | Templeton | |
| 3,559,732 A | | 2/1971 | Tucker | |
| 4,273,464 A | | 6/1981 | Scott | |
| 4,750,560 A | | 6/1988 | Gazda | |
| 4,913,229 A | | 4/1990 | Hearn | |
| 5,335,737 A | * | 8/1994 | Baugh | 175/61 |
| 5,341,873 A | * | 8/1994 | Carter et al. | 166/117.5 |
| 5,379,845 A | | 1/1995 | Blount et al. | |
| 5,425,419 A | * | 6/1995 | Sieber | 166/206 |
| 5,427,179 A | | 6/1995 | Bailey et al. | |
| 5,474,126 A | * | 12/1995 | Lynde et al. | 166/117.6 |
| 5,535,822 A | | 7/1996 | Schock et al. | |
| 5,678,634 A | * | 10/1997 | Rehbock et al. | 166/377 |
| 5,787,982 A | | 8/1998 | Bakke | |
| 5,971,078 A | * | 10/1999 | Ritorto et al. | 166/377 |
| 6,050,341 A | | 4/2000 | Metcalf | |
| 6,131,953 A | | 10/2000 | Connell et al. | |

(Continued)

FOREIGN PATENT DOCUMENTS

EP 0 701 040 3/1996

OTHER PUBLICATIONS

GB Search Report, Application No. GB0715075.8, dated Nov. 20, 2007.

(Continued)

*Primary Examiner* — Daniel P Stephenson
*Assistant Examiner* — Blake Michener
(74) *Attorney, Agent, or Firm* — Patterson & Sheridan, LLP

(57) ABSTRACT

Apparatuses and methods for retrieving a downhole tool from a wellbore are provided. The method includes running a retrieval tool into a wellbore on a conveyance. The retrieval tool configured to automatically manipulate into an engagement position with the downhole tool. Engaging the downhole tool with the retrieval tool and removing the downhole tool from the wellbore.

4 Claims, 5 Drawing Sheets

U.S. PATENT DOCUMENTS

| | | | | |
|---|---|---|---|---|
| 6,170,578 | B1 | 1/2001 | Edwards et al. | |
| 6,186,233 | B1 * | 2/2001 | Brunet | 166/298 |
| 6,213,206 | B1 | 4/2001 | Bakke | |
| 6,408,946 | B1 | 6/2002 | Marshall et al. | |
| 6,464,002 | B1 | 10/2002 | Hart et al. | |
| 6,591,905 | B2 | 7/2003 | Coon | |
| 6,843,314 | B2 * | 1/2005 | Toulouse et al. | 166/117.6 |
| 7,077,204 | B2 | 7/2006 | Cruickshank et al. | |
| 7,100,696 | B2 | 9/2006 | Marshall | |
| 7,152,674 | B2 | 12/2006 | Bowles | |
| 7,174,963 | B2 | 2/2007 | Bertelsen | |
| 7,353,867 | B2 | 4/2008 | Carter et al. | |
| 2003/0047318 | A1 * | 3/2003 | Cruickshank et al. | 166/377 |
| 2005/0252688 | A1 * | 11/2005 | Head et al. | 175/61 |
| 2005/0257930 | A1 | 11/2005 | Carter, Jr. et al. | |
| 2006/0207771 | A1 | 9/2006 | Rios, III et al. | |

OTHER PUBLICATIONS

Canadian Office Action, Application No. 2,597,966, dated May 12, 2009.

GB Examination Report for GB Application 0715075.8 dated Aug. 27, 2010.

Canadian Office Action for Application No. 2,597,966 dated Mar. 7, 2011.

GB Examination Report for Application No. GB0715075.8 dated Feb. 3, 2011.

* cited by examiner

SECTION A-A

DOWNHOLE TOOL RETRIEVAL AND SETTING SYSTEM

CROSS-REFERENCE TO RELATED APPLICATION

This application claims benefit of U.S. Provisional Patent Application No. 60/821,624, filed on Aug. 7, 2006, which is incorporated herein by reference in its entirety.

BACKGROUND OF THE INVENTION

1. Field of the Invention

Embodiments of the present invention generally relate to a downhole tool. More particularly, the invention relates to a whipstock retrieval tool. More particularly still, the invention relates to a self aligning retrieval tool configured to automatically engage a whipstock.

2. Description of the Related Art

During a drilling operation of oil and gas wells, a wellbore is formed in the Earth and typically lined with a tubular that is cemented into place to prevent cave in and to facilitate the isolation of certain areas of the wellbore for the collection of hydrocarbons. Once the tubular or casing is cemented into place, the hydrocarbons are typically gathered using a smaller string of tubulars called production tubing. Due to a variety of issues, including depletion of formations adjacent the wellbore and stuck tools and pipe that prevent continued use of the wellbore, it is often desirable to form another wellbore, not from the surface, but from some location along the existing wellbore. This new or lateral wellbore can also be lined with pipe and then hydrocarbons can be collected along its length. It is not uncommon to have more than one lateral or side-tracked wellbore extending from a single central or parent wellbore. Although wellbores are typically cemented with steel pipe or casing, as stated above, a lateral wellbore may also be utilized in an un-cased wellbore.

Initiating a lateral wellbore from a central wellbore requires an opening, hole, or window to be formed in the wall adjacent a location where the lateral wellbore will commence. Forming windows is typically done with the help of a whipstock, which is a wedge-shaped member having a concave face that can "steer" a mill or cutter to a side of the wall where the lateral wellbore will be formed. The whipstock may be run in by itself or, to save a trip, the whipstock might be run in with the mill or cutter temporarily attached to its upper edge. In either case, the whipstock has to be oriented and secured in the wellbore in order to properly direct the milling operation.

There are various means of orienting and securing a whipstock in a wellbore. For example, a retaining device, such as a packer or a seat, and an orientation device, such as a stinger disposed at the bottom of a whipstock, may be used to set the whipstock in a wellbore. Typically, the stinger device includes a splined arrangement that is configured to engage the retaining device previously disposed in the wellbore. Upon engagement of the splined arrangement with a packer or seat, the whipstock is rotated from the surface to a predetermined orientation where the lateral wellbore will commence. In order to rotate the whipstock from the surface, it is necessary to run the whipstock in on a jointed pipe in order to transfer rotation from the surface to the downhole location.

It is often necessary to remove a whipstock from a wellbore. A retrieval tool is used to retrieve a whipstock from a wellbore. The retrieval tool is run into the wellbore on jointed pipe and positioned adjacent the whipstock. A drilling rig is required to assemble the pipe as the tool is run in and to disassemble the pipe as the tool is removed. The retrieval tool is then rotated and manipulated from the surface until it couples with the whipstock. The retrieval tool is then removed from the wellbore along with the whipstock.

The use of jointed pipe is costly and time consuming. Continuous conveyances, such as wireline, are cheaper and less time consuming. However, due to the flexible nature of these conveyances, there is no effective way to transfer, manipulate, and rotate the retrieval tool in order to engage the whipstock.

Therefore, there is a need for a retrieval tool that is self aligning with the whipstock in order to be run into the wellbore on a flexible conveyance. There is a further need for a method and apparatus for setting a whipstock in a wellbore using a flexible conveyance, such as a wireline.

SUMMARY OF THE INVENTION

In accordance with the embodiments described herein there is provided generally a method of retrieving a tool in a wellbore. The method includes running a retrieval tool into the wellbore. Encountering the whipstock with a self aligning portion of the retrieval tool. Rotating the retrieval tool into an engagement position with the whipstock, wherein the rotating is accomplished by the self aligning portion maneuvering the retrieval tool along the whipstock in response to at least an axial force.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of apparatus and methods for retrieving a downhole tool are provided. In one embodiment, a retrieval tool is configured to align itself with the downhole tool, such as a whipstock. The self alignment is achieved using contours in the retrieval tool to guide the retrieval tool into engagement with the downhole tool. The retrieval tool is guided as it translates along the downhole tool in response to an axial force, such as gravity, transferred through the conveyance or a wire line tractor. As such, alignment of the retrieval tool with respect to the downhole tool requires no rotational or hydraulic manipulation from the surface. Therefore, the retrieval tool may be conveyed into the wellbore on a flexible conveyance such as a wire line, a slick line, coiled tubing, COROD®, etc. COROD® is a registered trademark of Weatherford International Ltd. and is herein defined as a coiled, solid conveyance. Further, the retrieval tool may be conveyed on a conventional conveyance such as a drill pipe.

Figure 1:
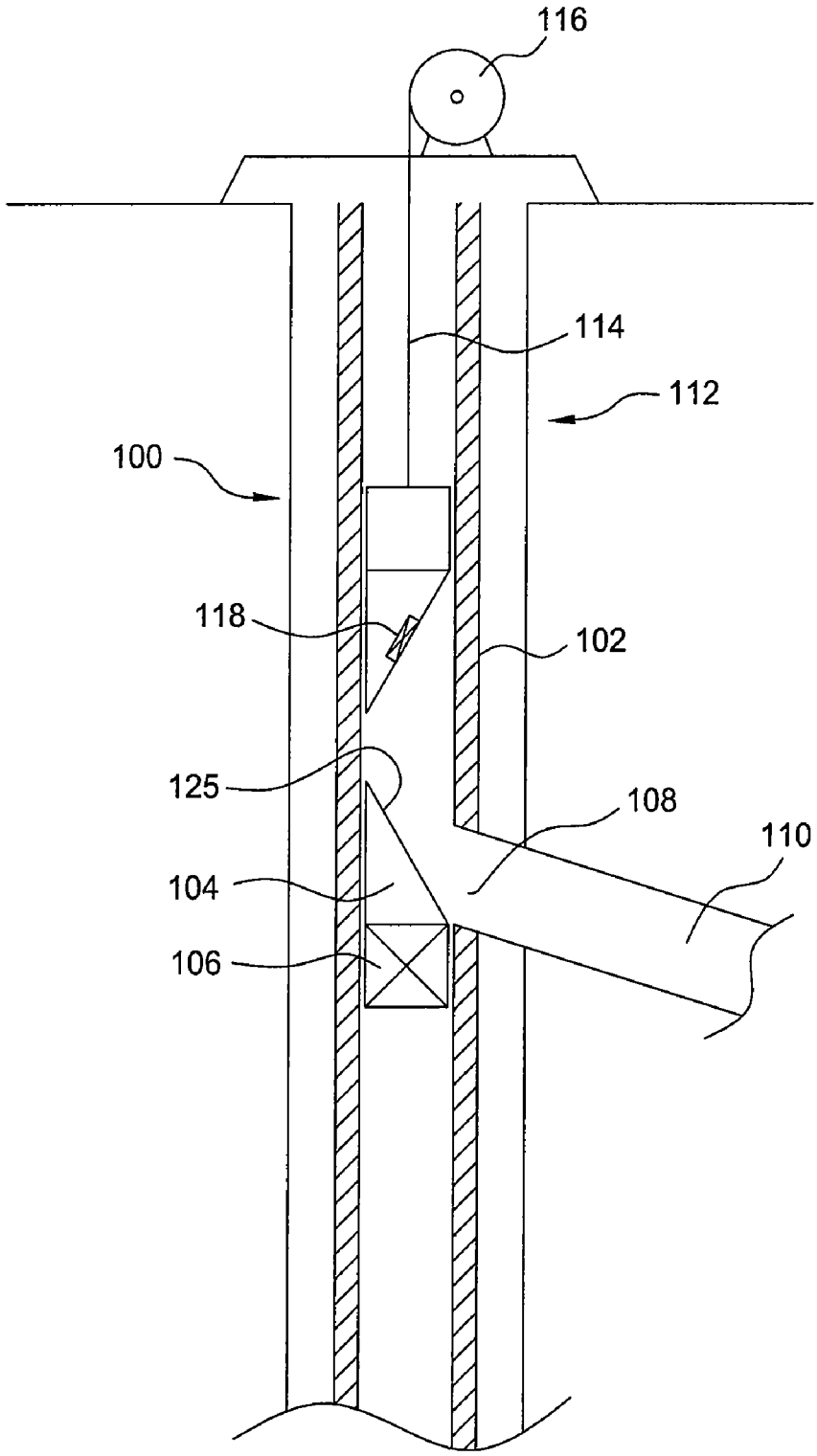
FIG. 1 illustrates a schematic of a wellbore with a whipstock and a retrieval tool according to one embodiment of the present invention.

FIG. 1 shows a wellbore 100 having a tubular 102 located within it. The tubular 102 may be any tubular used in downhole operations such as a casing. Within the tubular 102, a whipstock 104 has been set in place on a setting tool 106. The setting tool 106 may be a part of the whipstock 104 or a separate tool used to locate the whipstock 104 in the wellbore 100. The setting tool 106 may have a receiving profile, such as a mule shoe, for receiving a key of the whipstock 104 in order to orient the whipstock 104. With the whipstock 104 in place, a milling tool (not shown) is guided down a concave surface 125 of the whipstock 104 to form a window 108 in the wellbore 102. Thereafter, a lateral 110 is formed through the window 108 in order to produce from a variety of subterranean locations. Multiple laterals may be formed in the same way as described above.

A retrieval tool 112 is shown in FIG. 1 for removing the whipstock 104 from the wellbore. The retrieval tool 112 may be run into the wellbore 102 on a flexible conveyance 114. The flexible conveyance 114 may include, but is not limited to, a wireline, a slickline, coiled tubing, COROD®, rope, or a string. The flexible conveyance 114 is attached to a conveyance member 116 at the surface of the wellbore 102. An exemplary conveyance member 116 is a spool. The spool may be easily delivered and removed from the well site and may be incorporated into a mobile unit as a part of a truck or a trailer. The retrieval tool 112 has an engagement member 118, shown schematically, for coupling the retrieval tool 112 to the whipstock 104 as will be described in more detail below.

Figure 2:
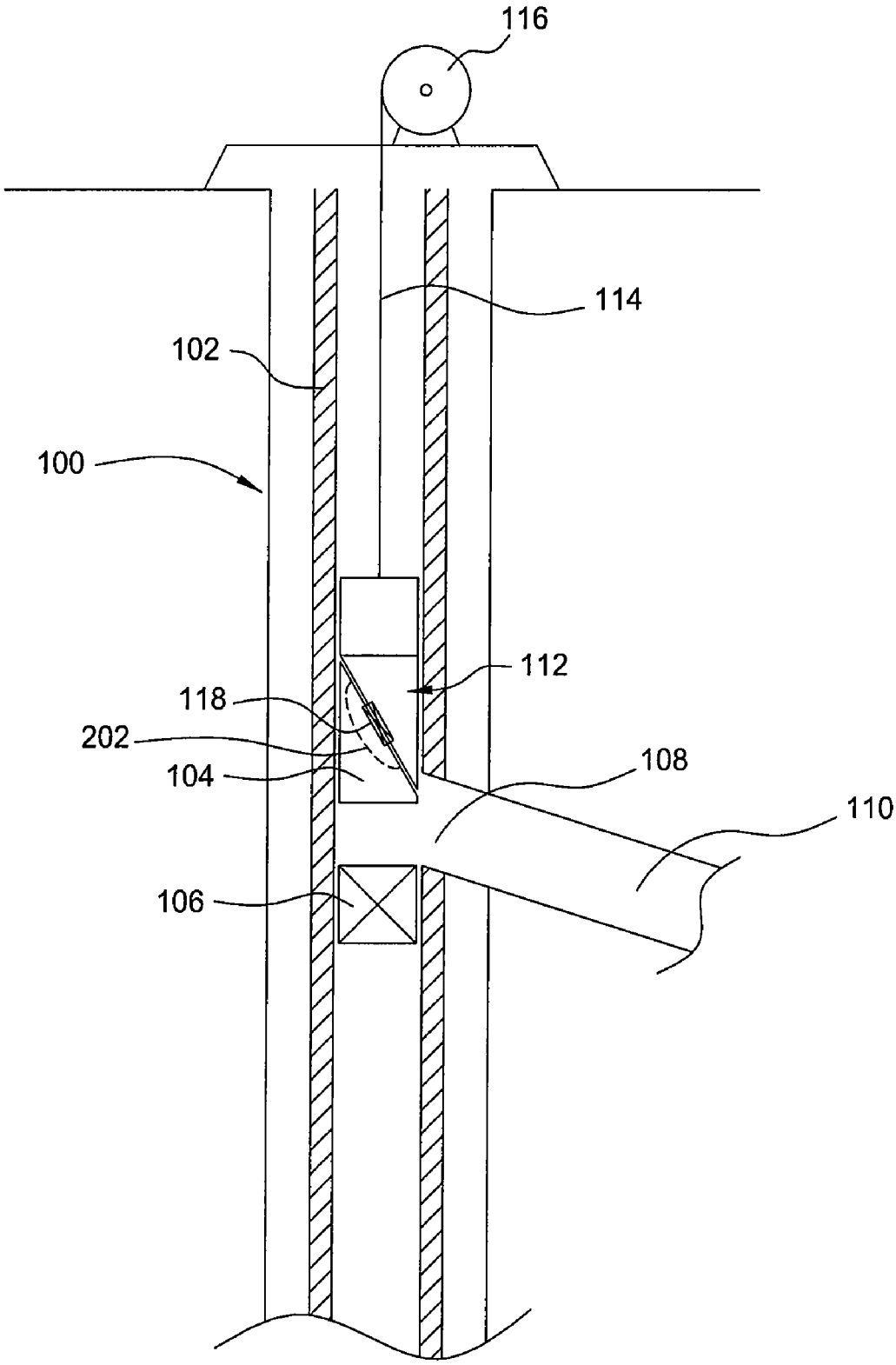
FIG. 2 illustrates a schematic of a wellbore with a whipstock and a retrieval tool according to one embodiment of the present invention.

FIG. 2 shows the retrieval tool 112 in an engagement position with the whipstock 104. The retrieval tool 112 has aligned itself to match the contours of the whipstock 104 as it traveled down the tubular 102. When the engagement member 118 of the retrieval tool 112 reaches a corresponding whipstock profile 202, the engagement member 118 automatically engages the profile 202. As shown in FIG. 2, the engagement member 118 is coupled to the profile 202 in the engagement position. The profile 202 may be an aperture or an indentation in the concave surface 125 of the whipstock 104. With the engagement member 118 coupled to the profile 202, the retrieval tool 112 may be pulled toward the surface to lift the whipstock 104. The whipstock 104 and retrieval tool 112 are removed together.

Figure 5:
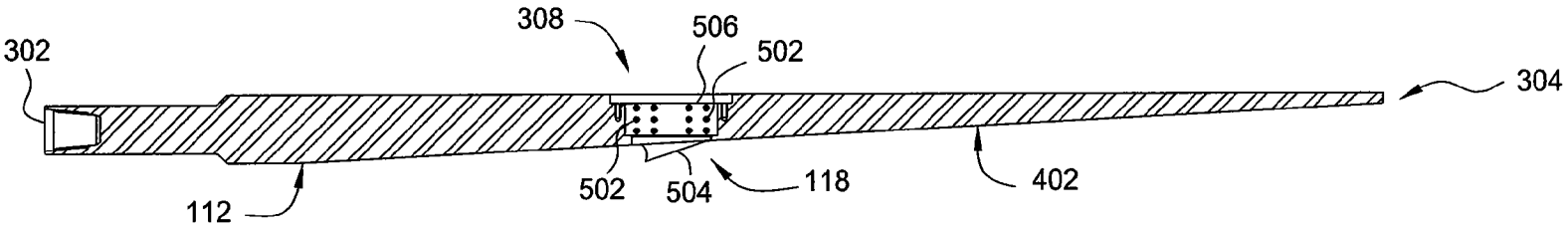
FIG. 5 illustrates a cross-sectional view of a retrieval tool according to one embodiment of the present invention.
Figure 3:
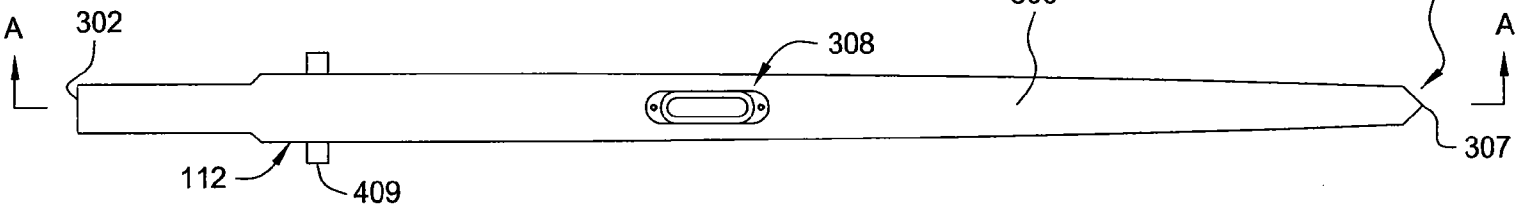
FIG. 3 illustrates a view of a retrieval tool according to one embodiment of the present invention.
Figure 4:
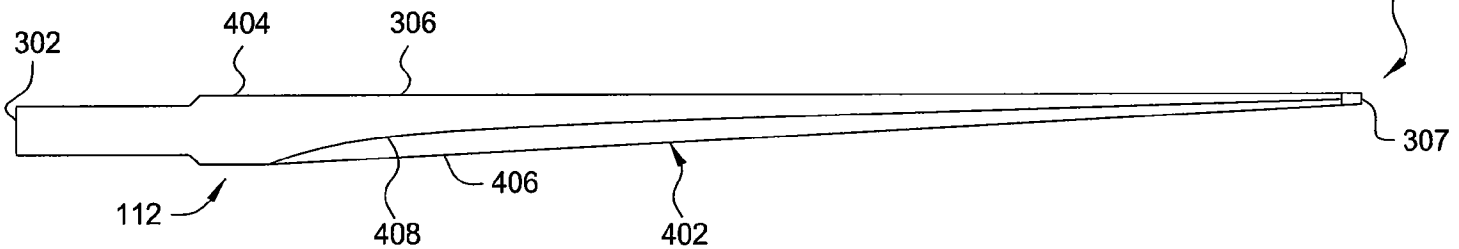
FIG. 4 illustrates a view of a retrieval tool according to one embodiment of the present invention.

FIGS. 3-5 are various views of the retrieval tool 112 according to one embodiment of the present invention. FIG. 3 is a top view of the retrieval tool 112. The retrieval tool 112 has a connector portion 302 for connecting to the conveyance 114, a lead end portion 304, a non-contoured side 306, and a port 308 (optional) for installing the engagement member 118. The non-contoured side 306 is adapted to match the inner diameter of the tubular 102, as will be described in more detail below. The lead end portion 304 is designed to guide the retrieval tool 112 along the concave surface 125 of the whipstock 104. In one embodiment the lead end portion 304 has an angled tip 307 to facilitate manipulation along the whipstock 104. The port 308 is an access way for containing a biasing member 502, shown in FIG. 5, which may bias the engagement member 118 away from the retrieval tool 112.

FIG. 4 is a side view of the retrieval tool 112. The side view shows the non-contoured side 306 on the top and a contoured side 402 on the bottom. The retrieval tool 112 may have a full diameter portion 404 which is designed to fit inside the inner diameter of the tubular 102. The contoured side 402 has an edge 406 in the middle which extends from the full diameter portion 404 to the angled tip 307. In addition, the contoured portion 402 has two curved edges 408, one is shown. The curved edges 408 run from the full diameter portion 404 to the angled tip 307 in a manner that gradually reduce the full circumference of the non-contoured side 306. Although the retrieval tool 112 is described as shown, it should be appreciated that any geometry may be used that would manipulate the retrieval tool 112 into engagement with the downhole tool.

FIG. 5 is a cross sectional view of the retrieval tool 112 along line A-A. The port 308 is shown extending through the retrieval tool 112 and includes the engagement member 118 disposed therein. In one embodiment the engagement member 118 comprises two biasing members 502, a hook 504, and a plate 506. The hook 504 is biased away from the contoured portion 402, as shown in FIG. 5, and stays in this position as it is run into the wellbore. The plate 506 is adapted for easy installation and access to the biasing members 502 and hook 504. When the hook 504 encounters another surface, such as the inner diameter of the tubular 102, an obstruction, or the concave surface 125 of the whipstock 104, the biasing force of the biasing member will be overcome, thereby retracting the hook 504 into the port 308. As the retrieval tool 112 slides along the concave surface of the whipstock 104, the hook 504 remains in the retracted position until it reaches the corresponding whipstock profile 202, shown in FIG. 2. The hook 504 will then move out of the port 308 and into the engagement position, due to the force exerted on it by the biasing members 502 in order to couple with the whipstock profile 202. Once coupled to the whipstock 104, the retrieval tool 112 may be pulled up and out of the wellbore 102. It should be appreciated that the biasing member 504 may be any suitable number and type of biasing members, such as a coiled spring, a leaf spring, etc. Further, the hook may be fixed or biased depending on the needs of a particular retrieval operation. Once the retrieval tool 112 is engaged with the whipstock 104, the hook 504 remains engaged with the whipstock 104 until both are removed from the wellbore. In an alternative embodiment, a release mechanism or latch, not shown, is incorporated with the hook 504 in order to disengage the whipstock 104 downhole after engagement.

In operation, a flexible conveyance 114 is coupled to the connector portion 302 of the retrieval tool 112. The retrieval tool 112 is run into the wellbore 100 by extending and lowering the conveyance 114 from the conveyance member 116. When the retrieval tool 112 is on a flexible conveyance such as a wireline, slickline, coiled tubing, or COROD®, the retrieval tool 112 may not be rotated into alignment from the surface. The retrieval tool 112 travels down the inner diameter of the tubular 102 with the lead end portion 304 downhole and the full diameter portion 404 up-hole. The full diameter portion 404 and the non-contoured side 306 have a diameter that is smaller than the inner diameter of the tubular 102. The full diameter portion 404 may also include centralizers 409 which are designed to allow the retrieval tool 112 to travel substantially in the center of the tubular 102 while allowing the retrieval tool 112 to have a decreased diameter. The retrieval tool 112 continues down the wellbore and eventually the angled tip 307 encounters the whipstock 104. The retrieval tool 112 may encounter the whipstock 104 in a position where the engagement member 118 is in rotational alignment with the profile 202 of the whipstock 104, or a position where the engagement member 118 is not in alignment with the profile 202. If the engagement member 118 and profile 202 are in alignment, the contoured side 402 of the retrieval tool 112 will travel along the concave surface 125 of the whipstock 104 until the engagement member 118 engages the profile 202. As the conveyance member 116 continues to unwind, slack will be placed in the conveyance 114 indicating that the retrieval tool 112 and the whipstock 104 are in the engagement position. The conveyance member 116 then lifts the conveyance 114 which in turn pulls the retrieval tool 112 and the whipstock 104 toward the surface.

In the situation where the engagement member 118 is not aligned with the profile 202 of the whipstock 104, the retrieval tool 112 is adapted to self align with the whipstock 104. The angled tip 307 encounters the upper end of the whipstock 104. In one embodiment, the angled tip 307 is designed to guide the lead end portion 304 of the retrieval tool 112 toward the concave surface 125 of the whipstock 104. With the lead end portion 304 adjacent the concave surface 125, the contoured side 402 of the retrieval tool 112 will rotate the retrieval tool 112 at least partially circumferentially as it travels along the concave surface 125. The rotation will continue until the engagement member 118 is aligned with profile 202 and the non-contoured side 306 is facing the inner diameter of the tubular 102 or the window 108. The conveyance member 116 will continue to lower the conveyance 114 allowing gravity to pull the retrieval tool 112 along the concave surface 125. The retrieval tool 112 travels down until the engagement member 118 engages the profile 202. The whipstock 104 and retrieval tool 112 are then removed from the wellbore 100 as described above.

If the retrieval tool 112 encounters the whipstock 104 at substantially a 180° angle from the engagement position, the retrieval tool 112 is designed so that the engagement member 118 will not engage the window 108. In the event that the lead end portion 304 of the retrieval tool 112 directly encounters the uppermost end of the whipstock 104, the full diameter portion 404, or the centralizers maintain the retrieval tool 112 in a position substantially in line with the tubular 102. The full diameter portion 404 or the centralizers may have an outer diameter which substantially matches the inner diameter of the tubular 102. The outer diameter will keep the retrieval tool 112 substantially in line with the bore of the tubular 102. Thus, the retrieval tool 112 will not rotate to a position in which the engagement member 118 may engage the window 108. In this position, the retrieval tool 112 may reach a depth at which further downward movement is prohibited due to the geometry and the angle of the whipstock 104 at the uppermost end. If the retrieval tool 112 and the whipstock's 104 geometrical juxtaposition prevent further downward movement of the retrieval tool 112, the retrieval tool 112 may then be raised clear of the whipstock 104. This will allow the retrieval tool 112 to freely rotate. The retrieval tool 112 is then lowered until it is in the engagement position as described above.

In an alternative embodiment, a tractor, not shown, may be used in conjunction with the flexible conveyance 114 to axially propel downhole tools such as the whipstock 104 or the retrieval tool 112. The tractor and retrieval tool 112 may be run to a position adjacent the whipstock 104. The tractor may then move the retrieval tool 112 along the whipstock 104. The retrieval tool 112 will self align to the engagement position as described above. Once in the engagement position the tractor may assist in raising the retrieval tool 112, thereby lifting the whipstock 104 and freeing it from the tubular 102.

In another alternative embodiment, the retrieval tool 112 is used with in a deviated or horizontal well including extended reach horizontal wells. In the horizontal well gravity does not assist the alignment of the retrieval tool 112. Therefore, a force must be applied to the retrieval tool 112 during the alignment process. The force may be provided by any suitable method of providing a force including, but not limited to, a tractor, a drill pipe, COROD® or a coiled tubing. The force will align the retrieval tool 112 in the same manner as described above. Further, the full diameter portion 404 may maintain the retrieval tool 112 in a central position in the horizontal well.

In another embodiment, the downhole tool, such as a whipstock or re-entry guide, is adapted to guide a lug, run down on a flexible conveyance, into a slot on the downhole tool. The lug would follow a guide path on the downhole tool until it is in a position to allow the conveyance to lift the downhole tool out of the wellbore.

Figure 6A:
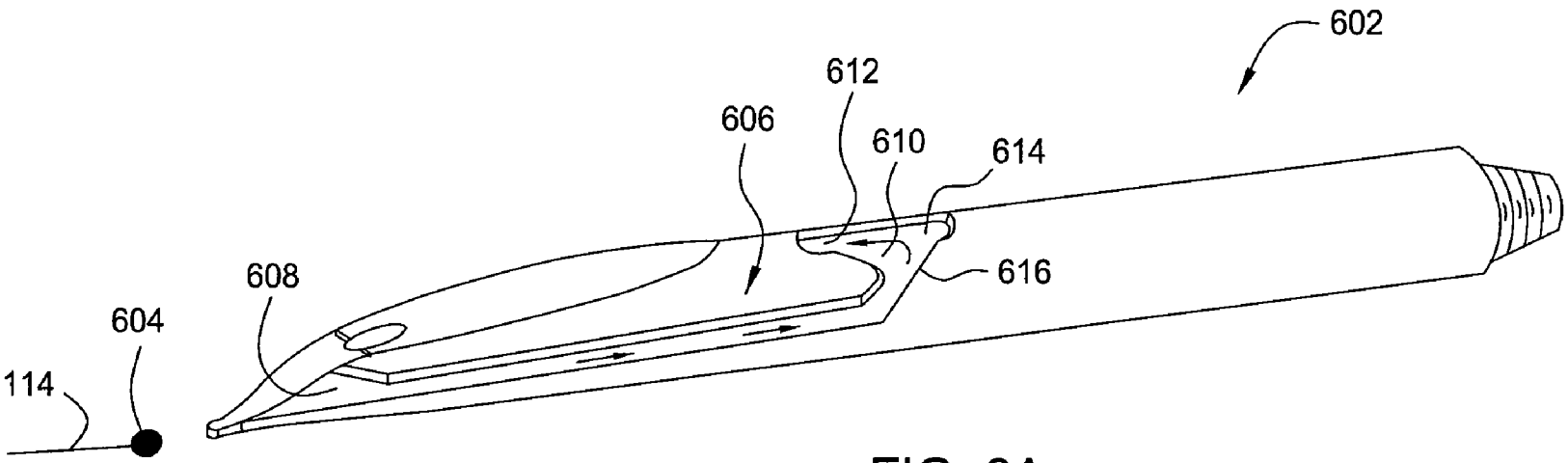
FIGS. 6A and 6B illustrates a schematic of a downhole tool having a slot for setting and retrieving the tool according to one embodiment of the present invention.
Figure 6B:
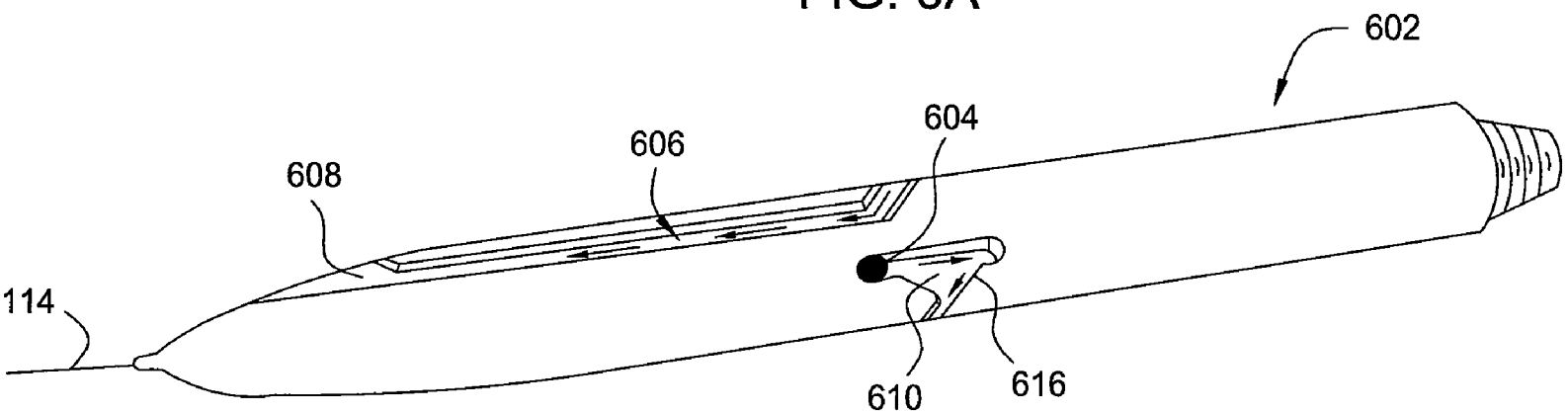

After the whipstock is removed from the wellbore a re-entry guide may be set on the setting tool 106, shown in FIG. 1. The re-entry guide may have a key adapted to rotationally align the re-entry guide with the profile or mule shoe of the setting tool 106. FIGS. 6A and 6B show a schematic view of an embodiment of a re-entry guide 602 adapted for retrieval using the flexible conveyance 114. The re-entry guide 602 has a slot 606 adapted to receive and manipulate a lug 604. The slot 606 has an entry portion 608 and an engagement portion 610. The entry portion 608 is located at an up hole end of the re-entry guide 602 and is adapted to receive the lug 604. The engagement portion 610 is adapted to guide the lug into an engaged and disengaged position using only the flexible conveyance 114. As shown in FIGS. 6A and 6B, the engagement portion 610 consists of an angled shaped slot having at least a dual slot formation with an upper slot 612 and a lower slot 614. It should be noted that in place of the re-entry guide 602, any suitable tool may be adapted with the slot 606, such as a whipstock, or deflector plate.

In operation, the re-entry guide 602 may be removed from the wellbore 100 using the lug 604 on a flexible conveyance 114. The lug 604 travels down the wellbore 100 and enters the entry portion 608 of the re-entry guide 602. The lug 604 follows the slot 606 and down the ramp 616 until the lug 604 is in the lower slot 614. Once in the lower slot 614, tension may be applied to the flexible conveyance 114 and the lug 604 will ride up into the upper portion of the upper slot 612 as shown in FIG. 6B. More tension may be applied to the flexible conveyance 114 in order to remove the re-entry guide 602 from the wellbore.

Figure 7:
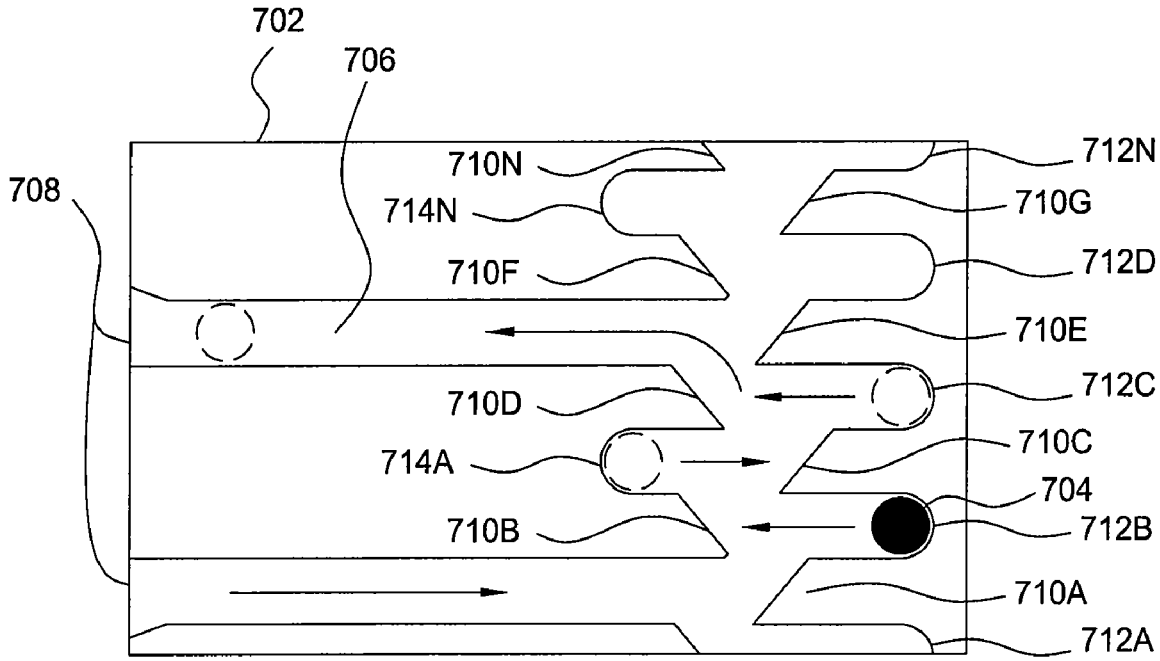
FIG. 7 illustrates an alternative slot for a downhole tool according to an alternative embodiment of the present invention.

In another embodiment, a series of slots 706 may be incorporated into a downhole tool 702, as shown in FIG. 7. The downhole tool 702 may be any downhole tool such as a whipstock, re-entry guide, etc. The series of slots 706 include an entry/exit portion 708, guide ramps 710A-N, and lower notches 712A-N and upper notches 714A-N. A lug 704 may be adapted to maneuver along the series of slots 706. The series of slots 706 may be adapted to encompass the entire circumference of the downhole tool 702 or only part of the circumference.

The downhole tool 702 may be set into and/or removed from the wellbore 100 in much the same manner as the re-entry guide 602. To set the downhole tool 702, the lug 704 is located in one of the upper notches 714 while the flexible conveyance 114 lowers the downhole tool 702 into the wellbore 100. The downhole tool is then set. The tension is taken out of the flexible conveyance 114, and the lug is allowed to fall onto the ramp 710C, as shown, and into the lower notch 712C. Once in the lower notch 712C, tension is reapplied to the flexible conveyance 114, and the lug 704 is lifted until it hits ramp 710D. The ramp 710D guides the lug 704 towards the exit slot 708, thereby releasing the flexible conveyance 114 from the downhole tool 702. To retrieve the downhole tool 702, the flexible conveyance 114 with the lug 704 is run into the wellbore 100. The lug 704 will enter entry slot 708 and travel down the slot 708 until encountering ramp 710A. The ramp 710A maneuvers the lug toward the lower notch 712B. Tension is then applied to the flexible conveyance 114, and the lug 704 moves up and hits ramp 710B which maneuvers the lug 704 into the upper notch 714A. The downhole tool 702 may then be removed from the wellbore 100.

While the foregoing is directed to embodiments of the present invention, other and further embodiments of the invention may be devised without departing from the basic scope thereof, and the scope thereof is determined by the claims that follow.

The invention claimed is:

1. A method of retrieving a whipstock used to form a window in a wellbore, wherein the window is located adjacent to the whipstock, comprising:

running a retrieval tool into the wellbore, wherein the retrieval tool includes a self-aligning portion configured to rotate the retrieval tool at least partially circumferentially within the wellbore, an outer diameter portion that is substantially equal to an inner diameter of the wellbore, and an engagement member configured to automatically engage a profile in the whipstock, wherein the whipstock includes a geometry and an angled upper end that prohibits movement of the retrieval tool beyond a depth at which the whipstock is located;

raising the retrieval tool clear of the whipstock after movement is prohibited due to a geometrical juxtaposition between the retrieval tool and the whipstock, thereby allowing the retrieval tool to freely rotate;

encountering the whipstock with the retrieval tool, thereby contacting a concave surface of the whipstock only and such that the engagement member is located at an angle offset from an engagement position with the profile in the whipstock;

maintaining the retrieval tool substantially in alignment with the inner diameter of the wellbore to prevent the engagement member from engaging the window as the retrieval tool encounters the whipstock; and retrieving the whipstock.

2. The method of claim 1, wherein the outer diameter portion of the retrieval tool includes at least one of a full diameter portion and a centralizer configured to maintain the retrieval tool substantially in alignment with the wellbore.

3. The method of claim 2, wherein the retrieval tool encounters the whipstock such that the engagement member is located at substantially a 180 degree angle from the engagement position with the profile in the whipstock.

4. The method of claim 2, further comprising re-running the retrieval tool into engagement with the whipstock, using the self-aligning portion to rotate the retrieval into the engagement position, and automatically biasing the engagement member into engagement with the profile in the whipstock.

* * * * *